US006857999B2

(12) United States Patent
Jeanvoine

(10) Patent No.: US 6,857,999 B2
(45) Date of Patent: Feb. 22, 2005

(54) METHOD FOR DESTROYING AND/OR INERTING WASTE

(75) Inventor: Pierre Jeanvoine, Poissy (FR)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 10/450,658

(22) PCT Filed: Dec. 12, 2001

(86) PCT No.: PCT/FR01/03958

§ 371 (c)(1),
(2), (4) Date: Jun. 16, 2003

(87) PCT Pub. No.: WO02/48612

PCT Pub. Date: Jun. 20, 2002

(65) Prior Publication Data

US 2004/0049094 A1 Mar. 11, 2004

(30) Foreign Application Priority Data

Dec. 15, 2000 (FR) ..... 00/16403

(51) Int. Cl.[7] ..... F23G 7/10; F23G 7/14; F23G 5/33

(52) U.S. Cl. ..... 588/252

(58) Field of Search ..... 588/252, 201, 588/11, 242; 65/134.8

(56) References Cited

U.S. PATENT DOCUMENTS 5,615,626 A * 4/1997 Floyd et al. ..... 588/201

6,460,376 B1 * 10/2002 Jeanvoine et al. ..... 65/134.2

FOREIGN PATENT DOCUMENTS

| | | |
|---|---|---|
| EP | 0 692 678 | 1/1996 |
| EP | 0 712 811 | 5/1996 |
| EP | 0 952 394 | 10/1999 |
| EP | 0 990 847 | 4/2000 |
| WO | 91 02824 | 3/1991 |
| WO | 96 11359 | 4/1996 |
| WO | WO 99/35099 * | 7/1999 |

* cited by examiner

*Primary Examiner*—John Kreck
(74) *Attorney, Agent, or Firm*—Oblon, Spivak, McClelland, Maier & Neustadt, P.C.

(57) ABSTRACT

A subject matter of the invention is a process for destroying waste and/or rendering it inert, in particular industrial, biological or farm-produce waste: use is made of a reactor provided with heating means comprising at least one submerged burner, and said reactor is fed with at least partially vitrifiable materials, which are heated with said heating means in order to form and to maintain, in the reactor, an at least partially liquid/foamy phase at at least 800° C. Then said waste is introduced into said phase in order for its organic components to be decomposed therein by combustion and/or its inorganic components to be melted or coated in said phase. Finally, said phase, charged with molten/coated waste and/or with combustion products from said waste, is withdrawn from the reactor.

40 Claims, No Drawings

METHOD FOR DESTROYING AND/OR INERTING WASTE

The invention relates to a process intended to treat waste, in particular industrial, farm-produce or biological waste, in order to destroy it or at the very least in order to render it inert and without danger to the environment.

This is because it is a problem, posed with increasing acuteness, to know how to avoid the storage of waste which may be toxic to varying extents or how to destroy it or "to render it inert" in the most efficient and the most economical way possible.

Solutions have already been provided to respond to this problem. It is thus known to mix waste with hydraulic binders, a technique which is advantageous with regard to energy consumption but which is not optimum in the long term. This is because cements generally exhibit a porosity which promotes the release of the waste thus trapped.

It is also known to vitrify waste, that is to say to introduce it into a composition formed from vitrifiable materials brought to their melting temperature. While the vitrification technique appears to be highly reliable, it is, on the other hand, fairly greedy with regard to consumption of vitrifiable raw materials and with regard to energy consumption.

The aim of the invention is thus to overcome these various disadvantages by providing a waste treatment process which is both highly reliable and economically viable.

A subject matter of the invention is first of all a process for destroying waste and/or rendering it inert, in particular industrial, biological or farm-produce waste, such that use is made, for the implementation, of a reactor provided with heating means comprising at least one submerged burner. The reactor is fed with at least partially vitrifiable materials, which are heated with said heating means in order to form and to maintain, in the reactor, an at least partially liquid and/or foamy phase at at least 800° C. The waste to be treated is introduced into this phase, in order for their possible organic components to be decomposed via combustion and/or for their possible inorganic components to be melted or coated in this phase. Said phase, charged with molten/coated waste and/or with combustion products from said waste of the ash type, is then withdrawn from the reactor.

Within the meaning of the invention, the term "submerged burners" should be understood as meaning burners configured so that the "flames" which they generate or the combustion gases resulting from these flames develop in the reactor where the conversion is taking place, within the very mass of the materials being converted. Generally, they are positioned so as to be flush with or to project slightly from the side walls or from the floor of the reactor used (the term "flames" is used here for greater simplicity, even if they are not, strictly, speaking, the same "flames" as those produced by overhead burners).

Within the meaning of the invention, the term "at least partially vitrifiable materials" is understood to mean any conventional starting material used to manufacture glass, silicates, such as sodium silicate and/or calcium silicate, but also alkali metal and/or alkaline earth metal phosphates, alkali metal and/or alkaline earth metal aluminates, or any combination of at least two of these compounds. They can be in particular any material which, by heat treatment, leads to an at least partially vitreous material which can be partially or completely ceramicized.

Within the meaning of the invention, the term "rendering inert" is understood to mean the operation consisting in rendering the waste inert. It can therefore relate either to destroying it entirely by combustion or to storing it in an intact or more or less decomposed but inert/inoffensive form. It then in fact relates to neutralizing it within the broad sense (not within the restrictive sense of a chemical reaction).

The operating principle of a furnace with submerged burners for the melting of glass is already known and has been disclosed in particular in patents WO99/35099 and WO99/37591: it consists in carrying out the combustion directly within the mass of the vitrifiable materials to be melted by injecting the fuel (generally gas of the natural gas type) and the oxidant (generally air or oxygen) via burners positioned under the level of the molten mass. This type of submerged combustion causes, by convection, intensive mixing of materials in the course of melting, which makes possible a rapid melting process and which also leads to the formation of a liquid phase which has slightly the appearance of a foam (with many "large" bubbles by comparison with the molten glass obtained with more conventional heating means of the submerged electrode or overhead burner type).

An additional advantage of this type of heating means is that it is possible to introduce the starting materials to be melted directly within this liquid/foamy phase, which avoids the formation of dust originating from the fines of the starting materials and the dispersion of the latter in the flue gases emitted by the furnace.

The invention thus took advantage of this technology to render inert/destroy the waste. A whole series of advantages results therefrom:

first, the waste can be introduced directly into the liquid/foamy phase, which prevents the escape of possibly toxic dust originating from the waste: waste can be effectively trapped in this phase, limiting the need to filter/treat the flue gases, secondly, it is possible to take advantage of the very nature of the waste to reduce the cost of the process.

This is because the waste to be treated, examples of which will be mentioned hereinbelow, can be inorganic or organic or can combine inorganic components and organic components. The composition of the waste can be optimized, in particular wastes of different natures can be combined, to reduce the cost of the starting materials and/or the energy cost of the process. Thus, inorganic waste comprising materials capable of melting at more than 800° C., such as molding sand or polluted cutlet, can be introduced into the reactor both to trap/destroy their polluting components and to introduce a portion of the vitrified material necessary for the process.

With regard to the organic waste, or partially organic waste, it can be used as fuel for the submerged burner(s): because of the convective mixing mentioned above, it is continually replaced close to the submerged burners until combustion is complete. This makes it possible to reduce, indeed even to completely halt, the feed of fuel gas to the burners, with a substantial energy saving. The decomposition of the organic molecules may thus be complete, as far as decomposition to carbon dioxide gas and water. The combustion ash is trapped in the liquid/foamy phase. This at least partially organic waste can therefore provide a portion, or the majority or the main part, indeed even all, the fuel necessary for the submerged burner(s). The fuel power of the waste, whatever its level, can therefore be used directly in the reactor.

It may be that carbon residues remain trapped in the vitreous matrix, which can offer the opportunity of manufacturing, at lower cost and without processing difficulty, reduced glasses.

In the case where that organic waste is retreated, a particularly economical process is obtained:

with regard to the energy, a large part, indeed even all, of the fuel is provided by the waste, with regard to the starting materials, a small amount of vitrifiable materials is sufficient since they have to trap only ash, which is low in volume. The level of replacement of said vitrifiable materials in the reactor may therefore be low, limited to the correct incorporation of this ash.

All compromises are subsequently possible: it is thus possible to combine various types of waste, for example waste with different degrees of toxicity (so that the final product observes the standards in force), waste of different natures (for example to provide a given content of organic compounds over the whole of the waste introduced, therefore to control the amount of fuel originating from the waste and consequently to adjust the feed of gas to the burners).

As mentioned above, many kinds of waste can be treated according to the invention. The following list is therefore not exhaustive:

waste regarded as nontoxic or only slightly toxic is composed in particular of at least one of the following industrial waste products: molding sand, glass furnace slag, scoria, clinker, television tubes and cutlet from various sources, such as glassworks cutlet. This category of waste can provide a portion of the formative and modifying oxides necessary to generate a vitreous matrix, waste regarded as more toxic can comprise, for example, at least one of the following waste products: any type of waste product from domestic refuse, in particular those waste products commonly denoted under the term REFIOM (Résidus de l'Epuration des Fumées d'Incinération des Ordures ménagères [Waste Products from the Purification of Flue Gases from the Incineration of Domestic Refuse]), any type of waste product from the incineration of industrial waste, in particular those waste products denoted under the term of REFIDI (Résidus de l'Epuration des Fumées d'Incinération de Déchets Industriels [Waste Products from the Purification of Flue Gases from the Incineration of Industrial Waste]), silicates, enamels, dust from electrostatic filters or from desulfurization, polluted cutlet, sludges from the iron and steel industry, filter-press cakes, and all oxides and hydroxides resulting from the chemical industry.

The waste targeted by the invention can also be biological in nature or result from the farm-produce industry. It relates more particularly to animal flour which can no longer be consumed or which will no longer be so in the near future in at least some European countries and which therefore has to be destroyed.

The waste can also be wood waste or paper waste from the paper industry.

It can also be composed of halogenated or nonhalogenated organic polymers, for example polyethylene, PVC or waste tires.

It can also relate to glass/plastic composites. Mention may be made of laminated windows for example, combining at least one glass with at least one sheet of thermoplastic or nonthermoplastic polymer, of the following type: poly (vinyl butyral) PVB, ethylene-vinyl acetate EVA, polyurethane PU or poly(ethylene terephthalate) PET, and the like. Mention may also be made of composite materials based on polymer reinforced by glass fiber (or carbon fiber or other type of reinforcing fiber), used in the automobile industry or in boats, for example. Mention may also be made of glass/metal composites (windows fitted with connection elements or with metal coatings).

A major innovation in the invention is to be able to adjust the operation of the heating means used, the submerged burners, according to the type and amount of waste to be destroyed/rendered inert (however, the invention includes the alternative forms where the heating means combine submerged burners and more conventional means, such as overhead burners). It is thus possible, preferably, to regulate the flow rates of gaseous oxidant and/or fuel feeding the submerged burner(s) according to the content of organic compounds in the waste and according to their gross calorific values.

The process according to the invention can be implemented batchwise but it preferably operates continuously. The waste and the vitrifiable materials can be introduced continuously into the reactor, in particular by adjusting the respective contents in order to obtain complete submersion of the waste and of their possible decomposition products in the liquid/foamy phase of the reactor. This control of the amounts introduced can be carried out automatically.

Advantageously, as mentioned above, the waste and/or the vitrifiable materials is/are introduced under the level of the liquid/foamy phase of the reactor, to as far as possible avoid or limit escapes of waste/fines.

Preferably, the gaseous effluents optionally comprising particles which are given off in the reactor are discharged and channeled in order to subject them, if required, to any appropriate filtration/decontamination treatment. These flue gases can subsequently be led to heat-recovery units in order for the heat to be extracted therein, or countercurrentwise to one of the feed streams of the reactor; the heat thus restored can, for example, be used to preheat waste and/or vitrifiable materials.

If this proves to be appropriate, the waste and/or the vitrifiable materials which are in the solid form can be milled/crushed before introducing them into the reactor, in particular in order to reduce them to aggregates of appropriate size.

The process is brought to completion by withdrawing, from the reactor, the phase laden with waste/waste decomposition products, which phase, once solidified, can be converted into aggregates.

It is thus possible to obtain a vitrified material which can be recovered in value, in particular for constituting cutlet or silicate (in particular sodium or calcium silicate), for making flat glass (windows), hollow glass (bottle, flasks), insulating mineral wool (glass wool, rock wool), or textile glass fiber, or reinforcement.

A vitrified material based on calcium silicate can thus be enhanced in value for the manufacture of silica-soda-lime flat glass or for the manufacture of textile glass (in the latter case, the use of a premolten calcium silicate can substitute in all or in part for the silica and for the time, which makes it possible to reduce the breakages of fiber beneath the spinneret).

The use of the vitrified material is therefore closely dependent on its composition. The important thing is that it conforms to the standards in force.

The vitrified materials/aggregates of lower quality can also be used as reinforcing filters, for example for road surfacings.

The invention will be described in more detail below using a nonlimiting implementational example.

A melting vessel is prepared, the walls of which are made of refractory materials, such as conventional glass furnaces, or of metal watts cooled with water. It defines a volume of substantially several $m^3$. Its bottom is equipped with several submerged burners, evenly positioned over the bottom, which penetrate into the reactor over a reduced height. Each burner is capable of being fed with air or with oxygen, on the one hand, and with fuel gas (of the natural gas or fuel oil or other combustible gas type), via two feed lines.

For safety purposes, when it is desired to halt the combustion, an inert gas, such as nitrogen, can be injected into the burner. The operation of the burners is disclosed in more detail in patent WO99/37591.

The reactor is fed with two endless-screw furnace charging devices, one for the vitrifiable materials and the other for the waste. It is also possible to provide a preliminary stage of mixing waste of various origins. It is also possible to mix vitrifiable materials and waste beforehand and to introduce them together into the reactor).

The process is initiated by feeding it first solely with vitrifiable materials (sand), which are melted at at least 1000° C. by virtue of the heat supplied by burners fed both with oxidant and with fuel. A semi-liquid bath of molten materials was then formed which is semi-foamy over a given height and is stirred by strong convective movements. The process can then be operated continuously: the reactor is fed continuously with waste and with vitrifiable materials. The relative amounts are adjusted according to the nature of the waste to be treated. The organic waste is entirely incinerated. The inorganic waste is melted or coated in the bath.

The amount and the nature of the inorganic materials introduced into the reactor (vitrifiable materials and materials forming part of the waste) are to be adjusted in order to provide the molten bath with a viscosity compatible with the operation of the submerged burners at the temperature under consideration but also to provide the best possible enhancement in value of the silicate which will be produced.

According to the amount of organic matter in the waste, the feed of gaseous fuel to the submerged burners is reduced or even halted during process (in addition, it is also possible to choose to introduce solid or liquid organic fuel into the reactor). The gaseous fuel/oxidant flow rate of the burners is continuously regulated according to the waste introduced into the reactor.

When the feed of gaseous fuel to the submerged burners is halted, the latter can be fed with air or with oxygen via their two feed lines.

The flue gases are removed in the top part of the reactor and can be retreated (for example for the purpose of recovering a particularly volatile inorganic component present in the waste).

The glass/silicate charged with inorganic waste and/or with combustion ash from organic waste is continuously discharged in the bottom part of the reactor via a tap hole. The residence time of the waste in the reactor is short. Although small, this type of reactor can rapidly treat large amounts of waste.

Various kinds of waste can be combined: it can be advantageous to combine one or more kinds of inorganic waste and one or more kinds of organic waste, at least in part; for example, it is possible to combine:

animal meal and REFIOMs, animal meal, polyethylene waste and REFIOMs, and the like, for the purpose of obtaining the best optimization in terms of economics and energy.

In conclusion, the process of the invention, even with highly compact reactors, makes it possible efficiently to destroy waste or to render it inert with an excellent yield, a reasonable energy cost and the ability to enhance in value the products obtained after treatment. It is therefore very competitive, by virtue of a novel application of the technology of submerged burners.

What is claimed is:

1. A process for destroying waste and/or rendering waste inert, which comprises:

feeding at least one partially vitrifiable material into a reactor having a heating means which comprises at least one submerged burner;

heating at least one partially vitrifiable material with said heating means;

forming and maintaining in the reactor an at least partially liquid/foamy phase at a temperature of at least 800° C.;

feeding into said liquid/foamy phase waste;

wherein at least one melted and/or coated material or decomposition product is obtained by feeding waste into said phase; and discharging a final phase without separating particulate material from the final phase.

2. A process as claimed in claim 1, wherein the waste is selected from the group consisting of products from the incineration of domestic refuse, waste products from the incineration of industrial waste, enamels, dusts from electrostatic filters and from desulfurization, polluted cutlet, sludges from the iron and steel industry, filter-press cakes, oxides and hydroxides resulting from the chemical industry, molding sand, scoria, clinker, sand polluted by hydrocarbons, glass furnace slag, wood waste or paper-manufacturing waste, animal meal, waste based on halogenated or nonhalogenated organic polymer, glass/plastic composites, glass/metal composites, and combinations thereof.

3. The process as claimed in claim 1, wherein the waste comprises at least one organic component which serves as fuel for the at least one submerged burner.

4. A process as claimed in claim 1, wherein the waste comprises at least one inorganic component comprising a vitrifiable inorganic component; and wherein the vitrifiable inorganic component is miscible with the liquid/foamy phase at at least 800° C. in the reactor.

5. A process as claimed in claim 1, wherein the waste comprises at least one organic component comprising at least one toxic organic component.

6. A process as claimed in claim 1, wherein the waste comprises at least two organic components comprising organic components with different gross calorific value.

7. A process as claimed in claim 1, wherein said feeding waste is continuous.

8. A process as claimed in claim 1, wherein said feeding waste is regulated such that the waste is completely immersed in the liquid/foamy phase.

9. A process as claimed in claim 1, wherein said feeding waste occurs under the level of the liquid/foamy phase.

10. A process as claimed in claim 1, wherein said feeding waste occurs under the level of the liquid/foamy phase by means of at least one conveyor-belt or endless-screw furnace charging device.

11. A process as claimed in claim 1, further comprising withdrawing the final phase comprising particulate matter and forming aggregates therefrom.

12. A process as claimed in claim 1, further comprising milling or crushing the waste further comprising solid material prior to said feeding waste.

13. A process as claimed in claim 1, further comprising forming vitrified material from said final phase comprising particulate material.

14. A process as claimed in claim 13, wherein the vitrified material is selected from the group consisting of a cutlet, a silicate, a flat glass, a hollow glass, a mineral wool, a textile, a glass fiber, a reinforcing filler, and combinations thereof.

15. A process as claimed in claim 1, further comprising vitrifying waste exhibiting different degrees of toxicity.

16. A process as claimed in claim 1, wherein the final phase comprising particulate material comprises at least one decomposition product and/or at least one melted and/or coated material from the reactor.

17. A process as claimed in claim 1, which further comprises regulating the heating of at least one partially vitrifiable material by varying the feeding into said liquid/foamy phase of said waste.

18. A process as claimed in claim 1, wherein the final phase comprises particulate matter.

19. A process as claimed in claim 1, wherein the waste comprises at least one inorganic component and/or at least one organic component.

20. A process as claimed in claim 1, wherein at least one coated decomposition product is obtained by feeding organic waste into said phase and at least one melted and/or coated material is obtained by feeding inorganic waste into said phase.

21. A process for destroying waste and/or rendering it inert, which comprises:

feeding at least one partially vitrifiable material into a reactor having a heating means which comprises at least one submerged burner;

heating at least one partially vitrifiable material with said heating means, leading to a molten glass;

forming and maintaining in the reactor an at least partially liquid/foamy glassy phase at a temperature of at least 800° C.;

feeding into said liquid/foamy phase waste comprising at least one inorganic component and/or at least one organic component;

wherein said feeding waste occurs under the level of said liquid/foamy glassy phase, wherein at least one melted and/or coated material is obtained, said material being embedded in glass, and discharging a final phase without separating particulate material from the final phase.

22. A process as claimed in claim 21, wherein the waste is selected from the group consisting of products from the incineration of domestic refuse, waste products from the incineration of industrial waste, enamels, dusts from electrostatic filters and from desulfurization, polluted cutlet, sludges from the iron and steel industry, filter-press cakes, oxides and hydroxides resulting from the chemical industry, molding sand, scoria, clinker, sand polluted by hydrocarbons, glass furnace slag, wood waste or paper-manufacturing waste, animal meal, waste based on halogenated or nonhalogenated organic polymer, glass/plastic composites, glass/metal composites, and combinations thereof.

23. The process as claimed in claim 21, wherein the waste comprises at least one organic component which serves as fuel for the at least one submerged burner.

24. A process as claimed in claim 21, wherein the waste comprises at least one inorganic component comprising a vitrifiable inorganic component; and wherein the vitrifiable inorganic component is miscible with the liquid/foamy phase at least 800° C. in the reactor.

25. A process as claimed in claim 21, wherein the waste comprises at least one organic component comprising at least one toxic organic component.

26. A process as claimed in claim 21, wherein the waste comprises at least two organic components comprising organic components with different gross calorific value.

27. A process as claimed in claim 21, wherein said feeding waste is continuous.

28. A process as claimed in claim 21, wherein said feeding waste is regulated such that the waste is completely immersed in the liquid/foamy phase.

29. A process as claimed in claim 21, wherein said feeding waste occurs under the level of the liquid/foamy phase.

30. A process as claimed in claim 21, wherein said feeding waste occurs under the level of the liquid/foamy phase by means of at least one conveyor-belt or endless-screw furnace charging device.

31. A process as claimed in claim 21, further comprising withdrawing the final phase comprising particulate matter and forming aggregates therefrom.

32. A process as claimed in claim 21, further comprising milling or crushing the waste further comprising solid material prior to said feeding waste.

33. A process as claimed in claim 21, further comprising forming vitrified material from said final phase comprising particulate material.

34. A process as claimed in claim 33, wherein the vitrified material is selected from the group consisting of a cutlet, a silicate, a flat glass, a hollow glass, a mineral wool, a textile, a glass fiber, a reinforcing filler, and combinations thereof.

35. A process as claimed in claim 21, further comprising vitrifying waste exhibiting different degrees of toxicity.

36. A process as claimed in claim 21, wherein the final phase comprising particulate material comprises at least one decomposition product and/or at least one melted and/or coated material from the reactor.

37. A process as claimed in claim 21, which further comprises regulating the heating of at least one partially vitrifiable material by varying the feeding into said liquid/foamy phase of said waste.

38. A process as claimed in claim 21, wherein the final phase comprises particulate matter.

39. A process as claimed in claim 21, wherein the waste comprises at least one inorganic component and/or at least one organic component.

40. A process as claimed in claim 21, wherein at least one coated decomposition product is obtained by feeding organic waste into said phase and at least one melted and/or coated material is obtained by feeding inorganic waste into said phase.

* * * * *

UNITED STATES PATENT AND TRADEMARK OFFICE

CERTIFICATE OF CORRECTION

PATENT NO. : 6,857,999 B2
DATED : February 22, 2005
INVENTOR(S) : Pierre Jeanvoine It is certified that error appears in the above-identified patent and that said Letters Patent is hereby corrected as shown below:

Column 2,
Line 45, change “cutlet”, to -- cullet --

Column 3,
Lines 24, 25 and 42, change “cutlet”, to -- cullet --

Column 4,
Line 43, change “cutlet”, to -- cullet --
Line 65, change “watts” to -- walls --

Column 6,
Lines 21 and 67, change “cutlet”, to -- cullet --

Column 7,
Line 47, change “cutlet”, to -- cullet --

Column 8,
Line 34, change “cutlet”, to -- cullet --

Signed and Sealed this

Twelfth Day of July, 2005

JON W. DUDAS
*Director of the United States Patent and Trademark Office*